United States Patent [19]

Huang et al.

[11] Patent Number: 4,953,696

[45] Date of Patent: Sep. 4, 1990

[54] DETACHABLE STATIONERY CASE RACK

[76] Inventors: Tony Huang, No. 165, Tzsiu N. Rd., Chang-Hwa City, Chang-Hwa Hsien; Johnny Huang, 7F-1, No. 101, Sec. 2, Ho-Ping E. Rd., Taipei, both of Taiwan

[21] Appl. No.: 419,191

[22] Filed: Oct. 10, 1989

[51] Int. Cl.[5] ..... A45C 11/34

[52] U.S. Cl. ..... 206/214; 206/45.11; 211/70; 211/78; 211/163

[58] Field of Search ..... 206/44 R, 44.11, 214, 206/561, 371, 45.11; 211/70, 78, 163, 164; 248/128, 130, 131

[56] References Cited

U.S. PATENT DOCUMENTS

| | | | |
|---|---|---|---|
| D. 160,688 | 10/1950 | Brock | 211/78 |
| 1,643,477 | 9/1927 | Warren | 248/131 |
| 2,964,201 | 12/1960 | Huffman | 211/70 |
| 3,017,035 | 1/1962 | Bogle et al. | 211/70 |
| 3,198,338 | 8/1965 | McCormick | 211/78 |
| 3,227,283 | 1/1966 | Ahlman | 211/163 |
| 3,489,289 | 1/1970 | Scott-Fenton | 211/78 |
| 3,498,471 | 3/1970 | Dirky | 211/163 |
| 3,998,334 | 12/1976 | Smith | 211/70 |
| 4,014,437 | 3/1977 | Rumble et al. | 211/78 |
| 4,305,511 | 12/1981 | Denholtz | 211/70 |
| 4,659,050 | 4/1987 | Tabayashi | 248/131 |
| 4,700,850 | 10/1987 | Morgan et al. | 211/163 |
| 4,736,915 | 4/1988 | Miller et al. | 248/131 |
| 4,823,966 | 4/1989 | Haber | 211/78 |

*Primary Examiner*—David T. Fidei

*Attorney, Agent, or Firm*—Bucknam and Archer

[57] ABSTRACT

This invention relates to a detachable stationery case rack and more particularly to the one which includes a polygonal bottom case divided into several receiving compartments defining therein a hollow central shaft for setting therein of a central column for further mounting thereon of stationery accessories receiving cases. The base of the stationery case rack has a packing set therein, which packing includes several round balls to permit rotation of the whole assembly against the base. Through series connection, the number of stationery receiving cases may be flexibly arranged according to requirement.

3 Claims, 3 Drawing Sheets

DETACHABLE STATIONERY CASE RACK

BACKGROUND OF THE INVENTION

Writing materials are very important in our daily life and daily work. To the people who are able to read and write, stationery has become an intimate companion in job.

During working or writing, a variety of materials may be used, such as pencil, ball-pen, crayon, rule, compasses, stapler, staples, clips, pins, eraser, knife, snap cutter, scissors, letter opener, etc. Because a variety of materials may be used, the collection and arrangement of which is very complicated and inconvenient.

Regular stationery cases or case racks which may have a clock or calculator attached thereto are generally of fixed type in fixed size and shape and not variable to fit in with working environment or the nature of work.

The main object of the present invention is to provide such a stationery case rack which is detachable and can be flexibly assembled into various combinations to satisfy different requirements.

The present invention will be fully understood from the following detailed description of the preferred embodiments referring to the annexed drawings in which:

DETAILED DESCRIPTION OF THE PREFERRED EMBODIMENTS

Figure 1:
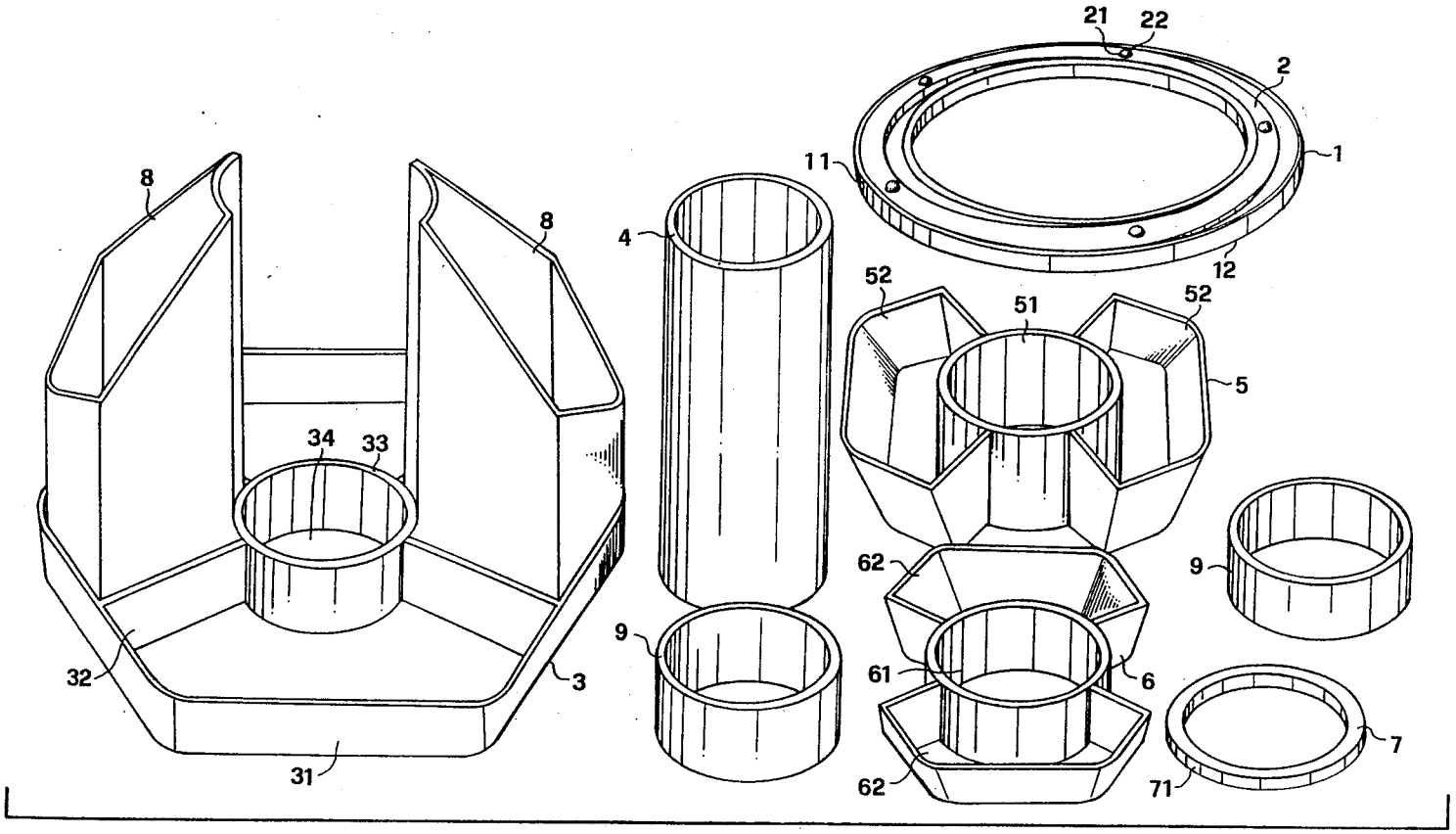
FIG. 1 is a schematic view illustrating the component parts used in assembling a detachable stationery case combination set of the present invention.

Turning now to the annexed drawings in detail and first referring to FIG. 1, therein illustrating are component parts for assembling a detachable stationery case rack of the present invention. According to the present invention, a detachable stationery case combination set is comprised of a base cushion 1, a circular packing 2, a bottom case 3, a central column 4, a middle rack 5, an upper rack 6, an upper cap 7, and two side cases 8.

The base cushion 1 has a ring-shaped body comprising raised side-wall 11, and a plurality of legs 12 at the bottom covered with elastic material to prevent from skidding.

The outer diameter of the circular packing 2 is slightly smaller than the base cushion 1 such that the circular packing 2 can be inserted in the case cushion 1. The circular packing 2 comprises a plurality of holes 21 made thereon for insertion therein of equal number of balls 22 respectively. Therefore, the circular packing 2 may be turned to revolve against the base cushion 1 when it bears heavy load.

The bottom case 3 may either be an equilateral polygonal case or a round-shaped case. In this embodiment, the bottom case 3 is a hexagonal case having an enclosed bottom and comprising vertically raised side-wall 31 defining therein a receiving space divided into several compartments by means of division walls 32. In the present embodiment, the bottom case 3 includes two large and two small compartments. A circular or polygonal hollow shaft 33 is raised from the case 3 in the center. In the present embodiment, the hollow shaft 33 has a circular outer configuration. According to the present invention, the hollow shaft 33 has internally a hole 34 defining an inner diameter slightly smaller than the outer diameter of the central column 4, such that the central column 4 can be resiliently set therein to become firmly secured thereto.

The central column 4 has a tubular structure of which the section and the size are specifically arranged to match with the hole 34, so that the central column 4 can be set in the hole 34 to stand upward from the bottom case (3).

The middle rack 5 includes a central hollow collar 51 with lateral cases 52 extending therefrom. The central hollow collar 51 is arranged in size suitable for insertion therethrough of the central column 4. The lateral cases 52 has an enclosed bottom for holding stationery accessories. The shape of the lateral cases 52 may be flexibly arranged according to requirement. In the present embodiment, two hexagonal cases are symmetrically disposed at both lateral sides of the hollow collar 51.

The upper rack 6 also includes a central hollow collar 61 with lateral cases 62 extending therefrom. The size of the lateral cases 62 is slightly smaller than the lateral cases 52 of the middle rack 5. Thus, a stepped case rack is formed after assembly for convenient picking-up therefrom stationery accessories received therein.

The upper cap 7 is a ring-shaped cap comprising inner circular wall 71 specially arranged in size to match with the central column 4 such that when the upper cap 7 is mounted on the central column 4 at the top, the inner circular wall 71 is inserted therein to let the upper cap 7 be firmly secured thereto.

The side cases 8 are bottom enclosed cases having a section matching, with the compartments of the bottom case 3 in which they are placed, and the central column 4, the middle rack 5 and the upper rack 6. The height of the side cases 8 may be flexibly arranged. In the present embodiment, the side cases 8 are as high as the central column 4 and have their side-walls obliquely extending upward outward, and they are respectively mounted on the compartments of the bottom case 3 against the lateral cases 62 of the upper rack 6 and the lateral cases 52 of the middle rack 5.

Figure 2:
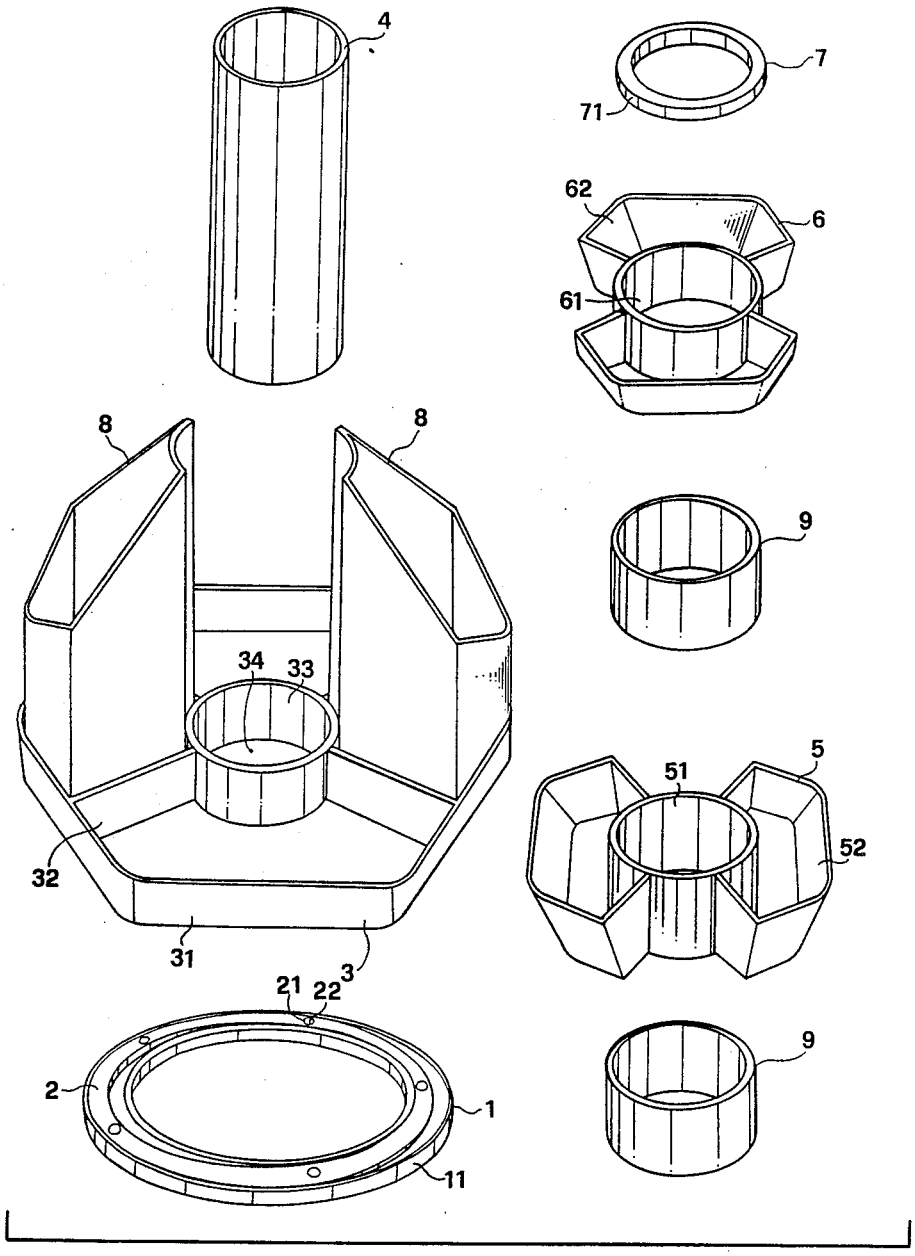
FIG. 2 is a perspective fragmentary view of the present invention.
Figure 3:
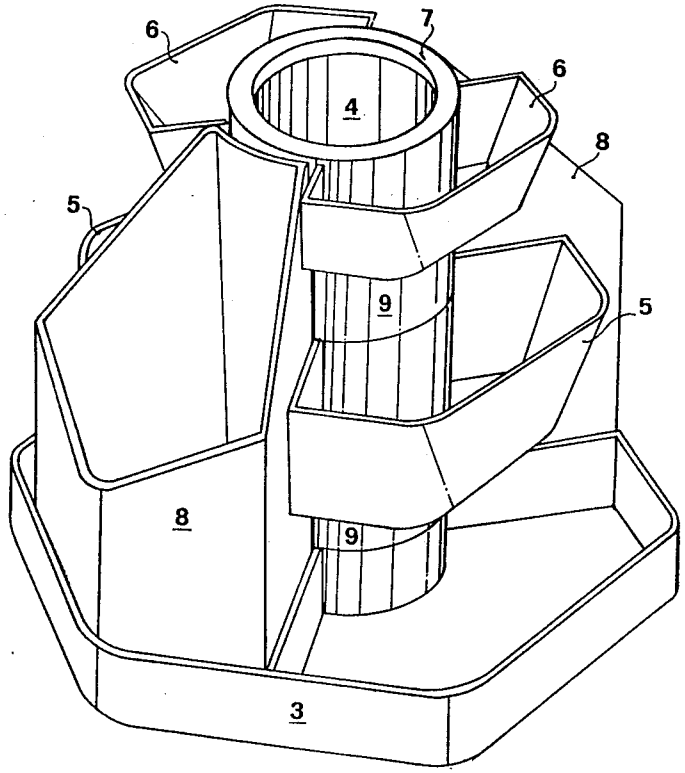
FIG. 3 is a schematic assembly view of a detachable stationery case combination set embodying the present invention.

To assemble the present invention is quite simple and outlined hereinafter with reference made to FIGS. 2 and 3. The circular packing 2 is revolvably set in the base cushion 2. The central column 4 is inserted into the center hole 34 of the hollow shaft 33 of the bottom case 3, and the middle rack 5 and upper rack 6 are mounted on the central column 4 in proper sequence letting the central column 4 penetrate through the hollow collars 51 and 61 respectively. The, the upper cap 7 is mounted on the central column 4 at the top, and the side cases 8 are respectively placed in the compartments of the bottom case 3 against the lateral cases 52 and 62 of the middle and upper racks 5 and 6. A completed assembly is thus formed as shown in FIG. 3.

Referring to FIGS. 2 and 3 again, in order to extend the range among the bottom case 3, the middle rack 5 and the upper rack 6 for convenient access, a socket 9 may be set between the bottom case 3 and the middle rack 5 as well as the middle rack 5 and the upper rack 6.

An assembly made according to foregoing statement will present a diversified configuration with a variety of shapes and sizes of receiving spaces disposed above the bottom case 3, in which the central column 4 is suitable for receiving therein elongated stationery such as rule, pen and etc., the side cases 8 are suitable for receiving therein snap cutter, stapler and etc., the lateral cases 52 and 62 and the bottom case 3 are suitable for receiving therein staples, clips, pins, thumb tacks and etc.

Figure 4:
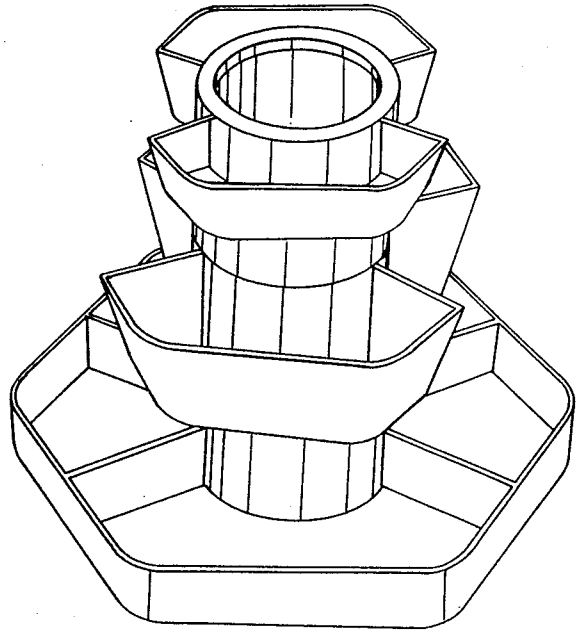
FIG. 4 is a schematic view illustrating an alternate form of the present invention.

According to the present invention, the assembly may be flexibly made to match with the place and job of work. As an alternate form of the present invention, the two side cases 8 may be eliminated from the assembly, as shown in FIG. 4, to present different combination design. Further, either one or the middle rack 5 and upper rack 6 may be eliminated for simple paper work.

As it is apparent from the forgoing specification, the invention is suceptible of being embodied with various alternations and modifications which may differ particularly from those that have been described in the preceding specification and description. It should be understood that we wish to embody within the scope of the patent warranted hereon all such modifications as reasonably and properly come within the scope of our contribution to the art.

We claim:

1. A detachable stationery case rack, including:

a base cushion having ring-shaped body comprising raised side-wall, and a plurality of bottom legs covered with elastic material;

a circular packing having an outer diameter slightly smaller than said base cushion and comprising a plurality of holes made thereon for insertion therein of equal number of balls respectively to permit rotating against said base cushion when it is mounted thereon;

a bottom case being an equilateral polygonal case divided by division walls into several compartments and comprising hollow shaft raised from the bottom in the center;

a central column having a tubular structure specially arranged in shape and size suitable for insertion into said hollow shaft of said bottom case;

a middle rack comprising a central hollow collar with lateral cases extending therefrom, which central hollow collar being arranged in size suitable for insertion therethrough of said central column;

an upper rack comprising a central hollow collar with lateral cases extending therefrom, which central hollow collar being arranged in size suitable for insertion therethrough of said central column;

an upper cap being a ring-shaped cap comprising inner circular wall specially arranged in size for insertion into said central column to let the upper cap be firmly secured thereto; and two side cases being bottom enclosed cases having a section matching with the compartments of said bottom case in which they stand, and said central column, said middle rack and said upper rack, of which the height does not exceed by said central column.

2. The detachable stationery case rack according to claim 1, wherein the side cases obliquely extending upward outward.

3. The detachable stationery case rack according to claim 1, wherein a socket is further mounted on the central column between the bottom case and the middle rack as well as the middle rack and the upper rack.

* * * * *